US009394874B2

(12) United States Patent
Nakamura et al.

(10) Patent No.: US 9,394,874 B2
(45) Date of Patent: Jul. 19, 2016

(54) GLOW PLUG DRIVING CONTROL METHOD AND GLOW PLUG DRIVING CONTROL DEVICE

(75) Inventors: Tomohiro Nakamura, Saitama (JP); Yutaka Tanaka, Saitama (JP); Yoshihito Fujishiro, Saitama (JP)

(73) Assignee: Bosch Corporation, Tokyo (JP)

( * ) Notice: Subject to any disclaimer, the term of this patent is extended or adjusted under 35 U.S.C. 154(b) by 242 days.

(21) Appl. No.: 14/118,105

(22) PCT Filed: May 14, 2012

(86) PCT No.: PCT/JP2012/062253

§ 371 (c)(1),
(2), (4) Date: Nov. 15, 2013

(87) PCT Pub. No.: WO2012/157595

PCT Pub. Date: Nov. 22, 2012

(65) Prior Publication Data

US 2014/0102396 A1 Apr. 17, 2014

(30) Foreign Application Priority Data

May 19, 2011 (JP) ..... 2011-112815

(51) Int. Cl.
*F02P 19/02* (2006.01)
*F02D 41/24* (2006.01)

(52) U.S. Cl.
CPC ..... *F02P 19/025* (2013.01); *F02P 19/02* (2013.01); *F02P 19/023* (2013.01); *F02D 41/2435* (2013.01)

(58) Field of Classification Search
CPC F02D 2041/2058; F02P 19/02; F02P 19/021; F02P 19/025; F02P 19/026
USPC ..... 123/179.15, 179.21, 179.6, 143 R, 123/145 A, 169 R, 594–597, 623; 701/102, 701/113; 219/200, 205, 206, 482, 490, 492, 219/497, 506
See application file for complete search history.

(56) References Cited

U.S. PATENT DOCUMENTS
4,934,349 A 6/1990 Demizu
6,009,369 A * 12/1999 Boisvert ..... F02P 19/026 123/145 A (Continued)

FOREIGN PATENT DOCUMENTS

CN 101586517 11/2009
DE 102009046438 5/2011

(Continued)

OTHER PUBLICATIONS
International Search Report for Application No. PCT/JP2012/062253 dated Jun. 26, 2012 (English Translation, 2 pages).

*Primary Examiner* — John Kwon
*Assistant Examiner* — Johnny H Hoang
(74) *Attorney, Agent, or Firm* — Michael Best & Friedrich LLP

(57) ABSTRACT

The accuracy in controlling the heating temperature of a glow plug and the reliability of the control operation are improved. An electronic control unit 101 is configured such that a standard applied voltage for glow plugs 50-1 to 50-n is set according to the engine speed and the load conditions of the engine. In addition, a correction coefficient set in advance according to the temperature classification of the mounted glow plugs 50-1 to 50-n is readably stored in the electronic control unit 101 as a correction coefficient map. By multiplying the standard applied voltage by a correction coefficient K read from the correction coefficient map and applying a voltage of the multiplication result to the glow plugs 50-1 to 50-n as a driving voltage through the power circuit 102 to perform driving control, stable and reliable heating temperature control can be realized regardless of variations in the heating temperature characteristics.

2 Claims, 4 Drawing Sheets

(56) References Cited

U.S. PATENT DOCUMENTS

| | | | | |
|---|---|---|---|---|
| 6,637,392 | B2 * | 10/2003 | Jung | F02D 41/062 123/145 A |
| 7,500,457 | B2 * | 3/2009 | Hiramatsu | F02D 41/221 123/145 A |
| 8,115,144 | B2 * | 2/2012 | Cassani | F02P 19/022 123/145 A |
| 8,577,583 | B2 * | 11/2013 | Kernwein | F02P 19/022 123/145 A |
| 2005/0081812 | A1 * | 4/2005 | Toedter | F02D 41/064 123/145 A |
| 2008/0163840 | A1 * | 7/2008 | Toedter | F02P 19/026 123/145 A |
| 2008/0210186 | A1 * | 9/2008 | Stoller | F02P 19/022 123/145 A |
| 2009/0012695 | A1 * | 1/2009 | Kernwein | F02P 19/026 701/102 |
| 2010/0094524 | A1 * | 4/2010 | Ehlert | F02P 19/021 701/102 |
| 2010/0312416 | A1 * | 12/2010 | Demirdelen | F02P 19/025 700/300 |
| 2011/0011383 | A1 * | 1/2011 | Cassani | F02P 19/025 123/623 |
| 2011/0118952 | A1 * | 5/2011 | Fink | F02P 19/026 701/102 |
| 2011/0118964 | A1 * | 5/2011 | Tanaka | F02P 19/021 701/113 |
| 2011/0220073 | A1 * | 9/2011 | Sackmann | F02D 35/023 123/623 |
| 2011/0303650 | A1 * | 12/2011 | Sakurai | F02P 19/025 219/263 |
| 2013/0087114 | A1 * | 4/2013 | Joos | F02P 19/02 123/179.21 |

FOREIGN PATENT DOCUMENTS

| | | |
|---|---|---|
| EP | 2249025 | 11/2010 |
| JP | 63266172 | 11/1988 |
| JP | 2008157614 | 7/2008 |
| JP | 2008221735 | 9/2008 |
| JP | 2009168319 | 7/2009 |
| JP | 2010043603 | 2/2010 |
| JP | 201065661 | 3/2010 |
| JP | 2010175116 | 8/2010 |
| JP | 2010281315 | 12/2010 |
| WO | 2010001888 | 1/2010 |
| WO | 2011049132 | 4/2011 |

* cited by examiner

FIG. 4

| Gr | K |
|---|---|
| A | Ka |
| B | Kb |
| C | Kc |

GLOW PLUG DRIVING CONTROL METHOD AND GLOW PLUG DRIVING CONTROL DEVICE

BACKGROUND OF THE INVENTION

The present invention relates to a driving control method of a glow plug that is mainly used to aid the start of a diesel engine, and in particular, to improvement of the stability and reliability of temperature control.

In the vehicle using a diesel engine, a glow plug has been used for aiding the starting, and the stability and reliability of the temperature control have a large influence on the quality of combustion, in other words, the quality of the engine operation. Accordingly, it is an important issue how the stable power control can be realized.

Therefore, for power control of the glow plug, various control methods have been proposed and put into practical use from various points of view (for example, refer to JP-A-2009-168319 and WO2010/001888 and the like).

Incidentally, the actual temperature characteristics (heating characteristics) of the glow plug, that is, the heating temperature when a certain voltage is applied varies relatively in many cases depending on each glow plug even if a so-called production lot is the same. This is even more so if the production lot is different.

On the other hand, as power control of the glow plug in a vehicle, for example, a method is generally adopted frequently in which an appropriate driving voltage according to various kinds of engine speeds and the load conditions of the engine is set in advance on the basis of the conduction characteristics of the standard glow plug and is stored in an electronic control unit, which controls the operation of the vehicle, the driving voltage is read at any time during the actual operation of the vehicle, and the glow plug is driven by the read voltage.

However, as described above, when the variation in the temperature characteristics of the glow plug mounted in the vehicle appears great, a difference occurs between the target temperature and the actual temperature of the glow plug for the voltage applied as described above. This may cause a problem in that it becomes difficult to ensure an appropriate combustion state.

SUMMARY OF THE INVENTION

The invention has been made in view of the above-described situation, and it is an object of the invention to provide a glow plug driving control method and a glow plug driving control device by which the accuracy in controlling the heating temperature of a glow plug is improved and the stability and reliability of the control operation are improved.

According to a first aspect of the invention, there is provided a glow plug driving control method for controlling power application to a glow plug. The glow plug driving control method includes correcting a voltage applied to the glow plug, which is set according to operating conditions of an engine, using a correction coefficient, which is set in advance according to temperature characteristics of the glow plug, and applying the corrected voltage to the glow plug to perform driving control.

According to a second aspect of the invention, there is provided a glow plug driving control device including: an electronic control unit that performs driving control of a glow plug; and a power circuit that performs power application to the glow plug according to the glow plug driving control performed by the electronic control unit. The electronic control unit is configured such that a standard applied voltage for the glow plug is set according to operating conditions of an engine, and is configured to correct the standard applied voltage using a correction coefficient set in advance according to a temperature classification of a mounted glow plug and to apply the corrected voltage to the glow plug to perform driving control.

BRIEF DESCRIPTION OF THE DRAWINGS

FIG. 4 is a schematic diagram that schematically shows an example of the correction coefficient map stored in the electronic control unit that forms the glow plug driving control device shown in FIG. 1.

DETAILED DESCRIPTION

Hereinafter, an embodiment of the invention will be described with reference to FIGS. 1 to 4.

It will be noted that the members and arrangements described below are not intended to limit the present invention and can be variously modified within the scope of the gist of the present invention.

Figure 1:
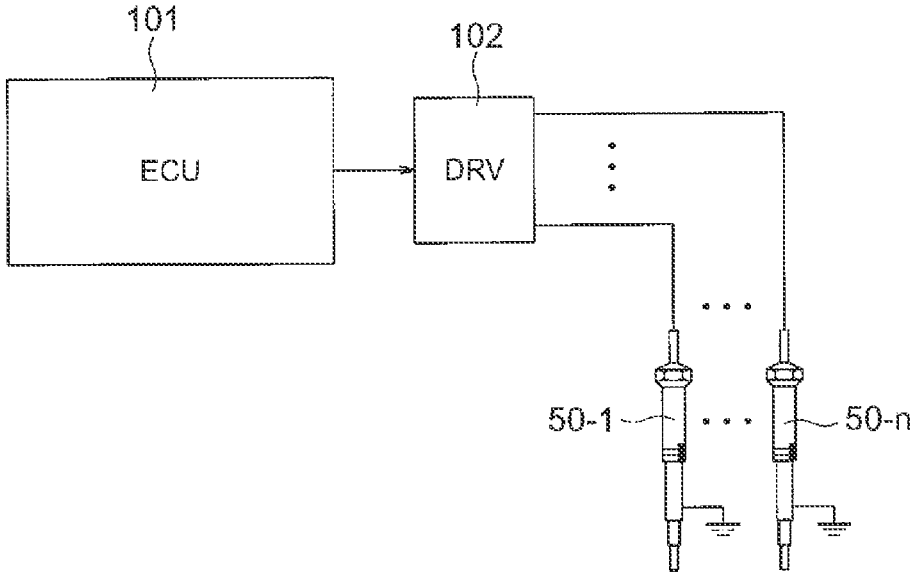
FIG. 1 is a block diagram showing an example of the configuration of a glow plug driving control device to which a glow plug driving control method according to an embodiment of the invention is applied.

First, an example of the configuration of a glow plug driving control device to which a glow plug driving control method according to the embodiment of the invention is applied will be described with reference to FIG. 1.

A glow plug driving device according to the embodiment of the invention is configured so as to be largely divided into an electronic control unit (in FIG. 1, denoted as an "ECU") 101 and a power circuit (in FIG. 1, denoted as a "DRV") 102.

For example, the electronic control unit 101 includes a microcomputer (not shown) as a main component, which has a known configuration, and a storage element (not shown), such as a RAM or a ROM, and also includes an input/output interface circuit (not shown) for transmission and reception of a signal to and from an external circuit. The electronic control unit 101 performs engine control, fuel injection control, and the like of the vehicle and performs glow plug driving control processing to be described later.

The power circuit 102 has a known configuration for performing power application to a plurality of glow plugs 50-1 to 50-n according to the glow plug driving control processing executed by the electronic control unit 101.

The glow plugs 50-1 to 50-n are provided corresponding to the number of cylinders of the engine (not shown), and one end of a heating element provided thereinside is connected to the output end of the power circuit 102 and the other end side of the heating element (not shown) is connected to the ground (vehicle body ground).

Next, the outline of a glow plug driving control method according to the embodiment of the invention will be described.

First, basic driving control of the glow plugs 50-1 to 50-n that has been conventionally performed will be described.

The voltage applied when driving the glow plugs 50-1 to 50-n is basically set to an appropriate value according to the operating conditions of the engine.

Here, the operating conditions of the engine are the concept indicating in which state the engine is, and includes both the conditions before the start of the engine and the conditions after the start of the engine.

First, before the start of the engine, a predetermined specified value as start mode according to the vehicle type or the engine type is used as the voltage applied to the glow plugs 50-1 to 50-n.

On the other hand, after starting the engine, an appropriate value according to the engine speed Ne and the load conditions of the engine is set as an applied voltage. That is, for various combinations of the engine speed Ne and the load conditions of the engine, the relationship with a voltage (hereinafter, referred to as a "standard applied voltage" for convenience of explanation) to be applied when driving a glow plug having standard temperature characteristics (heating characteristics) is calculated as a map on the basis of test or simulation results, and is stored in advance in an appropriate storage region of the electronic control unit 101. Then, an appropriate applied voltage is read from the map using the engine speed Ne and the load conditions of the engine when driving the glow plugs 50-1 to 50-n as parameters, and the read applied voltage is applied to the glow plugs 50-1 to 50-n. This is a conventional glow plug driving method.

In contrast, the glow plug driving control method according to the embodiment of the invention has been made in view of the fact that the standard applied voltage set on the basis of the standard glow plug is not necessarily a voltage value suitable for obtaining the desired temperature in the conventional driving control method described above.

That is, the glow plug driving control method according to the embodiment of the invention has been made taking into consideration that a certain amount of variation is inevitable to arise in the temperature characteristics of the glow plug during mass production.

Therefore, in the embodiment of the invention, when a glow plug mounted in a certain vehicle is determined, temperature characteristics are first measured for all glow plugs determined to be used, the glow plugs are classified according to the difference of the acquired temperature characteristics, a correction coefficient for correcting the standard applied voltage set on the basis of the standard glow plug is set for each classification, and the correction coefficient for each classification of the glow plug is stored in the electronic control unit 101.

On the other hand, in the step where a glow plug used for each vehicle is specifically specified, a specific code indicating to which classification the glow plug belongs is input to the electronic control unit 101, and the electronic control unit 101 recognizes to which classification the connected glow plugs 50-1 to 50-n belong.

Then, when driving the glow plugs 50-1 to 50-n, a correction coefficient corresponding to the glow plugs 50-1 to 50-n is read from the storage region of the electronic control unit 101, the standard applied voltage is corrected using the read correction coefficient, and the glow plugs 50-1 to 50-n are driven with the corrected applied voltage (corrected applied voltage).

Hereinafter, the procedure of determining a correction coefficient will be specifically described.

Figure 3:
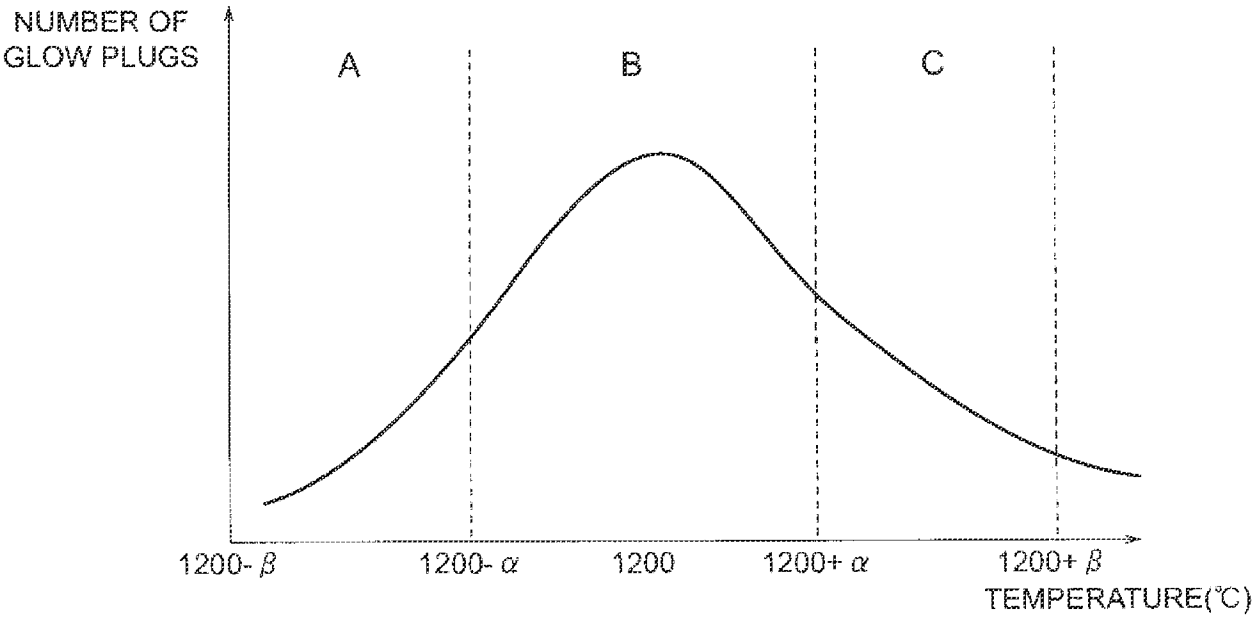
FIG. 3 is a schematic diagram that schematically shows an example of the normal distribution of variations in the heating temperature of a glow plug used in the glow plug driving control device shown in FIG. 1.

First, FIG. 3 shows a schematic diagram, which schematically shows an example of the normal distribution of variations in the heating temperature of a glow plug. Hereinafter, explanation will be given with reference to FIG. 3. In addition, in FIG. 3, the vertical axis indicates the number of glow plugs.

As shown in FIG. 3, assuming that the heating temperature when a voltage is applied in a specified condition is acquired by measurement for a plurality of glow plugs to be used, classification of the acquired heating temperature is performed according to the predetermined temperature classification criterion.

Here, the predetermined temperature classification criterion is a criterion for classifying the above-described glow plugs, for which heating temperature has been measured, into several temperature ranges.

In the example shown in FIG. 3, for example, the glow plugs are classified into three ranges of a range of $\pm\alpha$ around 1200° C. as a central value, a range equal to or higher than 1200° C.$-\beta$ and lower than 1200° C.$-\alpha$, and a range higher than 1200° C.$+\alpha$ and equal to or lower than 1200° C.$+\beta$. For convenience of explanation, a range where the temperature is equal to or higher than 1200° C.$-\beta$ and lower than 1200° C.$-\alpha$ is referred to as a first classification (in FIG. 3, denoted as "A"), a range of the temperature of 1200° C.$\pm\alpha$ is referred to as a second classification (in FIG. 3, denoted as "B"), and a range where the temperature is higher than 1200° C.$+\alpha$ and equal to or lower than 1200° C.$+\beta$ is referred to as a third classification (in FIG. 3, denoted as "C").

In addition, the magnitudes of $\alpha$ and $\beta$ should be separately determined in consideration of the specific conditions, such as the specific conditions of each vehicle or the characteristics of each glow plug used.

In addition, although there are three classifications of A, B, and C in the classification example described above, the invention does not need to be limited to the three classifications, and the number of classifications can be appropriately set.

In addition, when glow plugs are classified as described above, upon identification of each piece of data, it is preferable to distinguish each piece of data by attaching the integer for classifying each piece of data, in ascending order from 1, after the above-described letters A, B, and C to distinguish the classification to which each piece of data belongs. Specifically, for example, these are A01, A02, B01, B02, . . . .

Here, for convenience of explanation, these A01, A02, B01, B02, . . . are referred to as "group codes". In addition, reference signs A, B, and C when the above-described integer (01, 02, . . .) for identifying each piece of data is omitted are also referred to as "group codes" in the following explanation.

Then, a correction coefficient is set for each classification.

In the example shown in FIG. 3, a correction coefficient is calculated for the first classification (in FIG. 3, denoted as "A") and the third classification (in FIG. 3, denoted as "C"). That is, for the temperature median in each classification, a voltage correction value for obtaining the desired temperature can be calculated on the basis of test or simulation results.

On the other hand, for the second classification (in FIG. 3, denoted as "B"), the correction coefficient is set to "1" in this example since the temperature is in a desired temperature range.

The correction coefficient for each classification calculated as described above is stored in the electronic control unit 101 as a correction coefficient map indicating the correspondence of a group code and a correction coefficient corresponding to the group code, for example, as shown in FIG. 4. In addition, in FIG. 4, it is assumed that Ka means a correction coefficient of a glow plug having a group code A, Kb means a correction coefficient of a glow plug having a group code B, and Kc means a correction coefficient of a glow plug having a group code C. In addition, in the example shown in FIG. 3, Kb=1.

Next, the procedure of the glow plug driving control processing according to the embodiment of the invention executed by the electronic control unit 101 will be described with reference to a subroutine flowchart shown in FIG. 2.

Figure 2A:
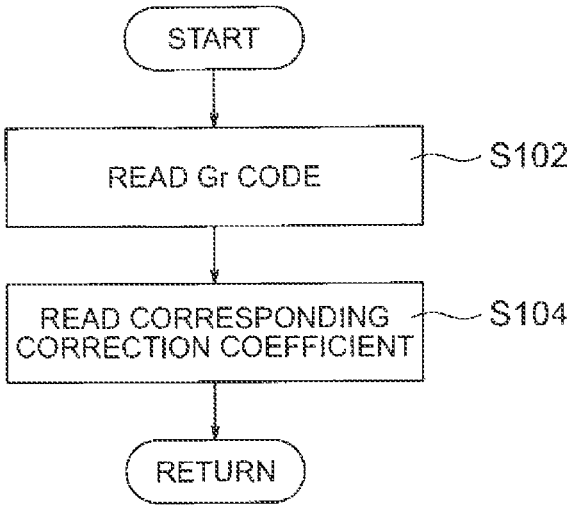
FIG. 2 is a subroutine flowchart showing the procedure of glow plug driving control according to the embodiment of the invention performed by an electronic control unit that forms the glow plug driving control device shown in FIG. 1.
Figure 2B:
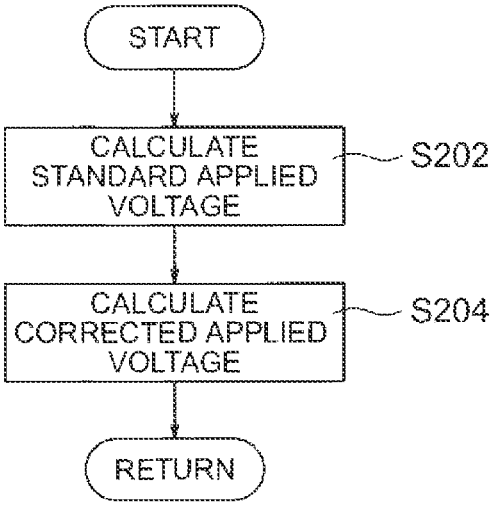

First, the glow plug driving control processing according to the embodiment of the invention is largely divided into processing executed only once when a glow plug driving control device is first started or when the glow plug driving control device performs driving first after the replacement of the glow plugs 50-1 to 50-1 (hereinafter, referred to as "initial processing" for convenience of explanation) and processing executed at any time when driving the glow plugs 50-1 to 50-1 (hereinafter, referred to as "repetitive processing" for convenience of explanation). FIG. 2(A) shows a subroutine flowchart showing the procedure of initial processing, and FIG. 2(B) shows a subroutine flowchart showing the procedure of repetitive processing.

First, the initial processing will be described with reference to the subroutine flowchart shown in FIG. 2(A).

When the processing is started by the electronic control unit 101, group (Gr) codes of the glow plugs 50-1 to 50-n stored in advance in the appropriate storage region of the electronic control unit 101 are first read (refer to step S102 in FIG. 2(A)).

Then, correction coefficients corresponding to the read group codes are read from the correction coefficient map (refer to FIG. 4) stored in the electronic control unit 101 in advance as described above, and are stored in the appropriate storage region for arithmetic processing in order to be used in the calculation of a corrected applied voltage to be described later (refer to step S104 in FIG. 2(A)).

Since a correction coefficient that has been read once may be used unless the glow plugs 50-1 to 50-n are replaced, a series of processes shown in FIG. 2(A) may be executed once when the operation is first started as a device as described above.

Next, the procedure of the repetitive processing will be described with reference to FIG. 2(B).

When the processing is started by the electronic control unit 101, a standard applied voltage is determined first (refer to step S202 in FIG. 2(B)). As the standard applied voltage, as described above, an appropriate value is set according to the operating conditions of the engine. That is, before the start of the engine, a predetermined specified value is used. Meanwhile, after the start of the engine, an appropriate value according to the engine speed Ne and the load conditions of the engine during the execution of this step is determined using a predetermined calculation expression or a map stored in advance in the appropriate storage region of the electronic control unit 101.

In addition, since the engine speed and the load conditions of the engine are data acquired in the engine control processing executed in the same manner as in the related art by the electronic control unit 101, it is sufficient to use the data, and it is not necessary to calculate the engine speed and the load conditions of the engine separately for the series of processes.

Then, on the basis of the previous correction coefficient and the above-described standard applied voltage Vdrv, an actual corrected applied voltage Vcorr applied to the glow plugs 50-1 to 50-n is calculated (refer to step S204 in FIG. 2(B)).

That is, the corrected applied voltage Vcorr is calculated as Vcorr=K Vdrv. Here, K is a correction coefficient. If the glow plugs 50-1 to 50-n belong to the first classification as shown in a previous example in FIG. 4, the value is Ka.

After the corrected applied voltage is applied in the manner described above, the series of processes is ended, and the process returns to the main routine (not shown) to perform power control for the glow plugs 50-1 to 50-n in the same manner as in the related art. In this case, the power control is performed using the corrected applied voltage calculated as described above.

In addition, as a method of inputting and storing the correction coefficient in the electronic control unit 101, for example, it is possible to adopt a method of inputting and storing the correction coefficient in the electronic control unit 101 by stamping a barcode indicating the correction coefficient on a glow plug in advance and reading the bar code using a bar code reader connected to the electronic control unit 101 when the glow plug is mounted in a vehicle.

In addition, in the embodiment of the invention described above, the storage or the reading of a correction coefficient and control, such as power control, are performed by the electronic control unit 101. However, for example, the power circuit 102 may be configured to include a microcomputer or a storage element, such as a RAM or a ROM, so that the storage or the reading of a correction coefficient and control, such as power control, are performed by the power circuit 102.

According to the invention, compared with conventional cases, power driving compensating for variations in the temperature characteristics of a glow plug can be performed more finely. Therefore, since it is possible to obtain the heating temperature more stability and reliably, there is an effect that a glow plug driving control device with higher stability and reliability of control operation can be provided.

The invention is suitable for a glow plug driving control device of a vehicle for which further stability and reliability of the heating temperature when driving a glow plug are required.

What is claimed is:

1. A glow plug driving control method for controlling power application to a glow plug, comprising:

correcting a voltage applied to the glow plug, which is set according to operating conditions of an engine, using a correction coefficient, which is set in advance according to temperature characteristics of the glow plug by measuring a temperature under predetermined power application conditions for the glow plug to be used, classifying the measurement result into a plurality of temperature ranges, acquiring an applied voltage, which is required for obtaining a target temperature targeted at the time of driving after mounting into a vehicle for a central product of glow plugs belonging to the classification, as an actual applied voltage for each of the classifications, and calculating a ratio of the actual applied voltage for each of the classifications to a standard applied voltage, which is a voltage applied to the glow plug at the time of driving that is set on the basis of a central product of all of the glow plugs to be used, as each correction coefficient, and applying the corrected voltage to the glow plug to perform driving control, wherein the correction coefficient set according to the temperature characteristics of the glow plug corresponds to the classification to which the glow plug to be used belongs.

2. A glow plug driving control device comprising:

an electronic control unit that performs driving control of a glow plug; and a power circuit that performs power application to the glow plug according to the glow plug driving control performed by the electronic control unit, wherein the electronic control unit is configured such that a standard applied voltage for the glow plug is set according to operating conditions of an engine, and is configured to correct the standard applied voltage using a correction coefficient set in advance according to a temperature classification of a mounted glow plug and to apply the corrected voltage to the glow plug to perform driving control, wherein, in the electronic control unit, a group code corresponding to the temperature classification to which the mounted glow plug belongs is input in advance and a correction coefficient map that defines a correspondence of the group code and a correction coefficient is stored in advance, and when the group code is input, a correction coefficient corresponding to the input group code is determined by the correction coefficient map, wherein for the temperature classification of a glow plug, a temperature is measured under predetermined power application conditions for a glow plug to be used, and the measurement result is classified into a plurality of temperature ranges, the group code is set to identify the classification, and the group code corresponding to the classification to which each glow plug belongs is given for each glow plug, for the correction coefficient for each temperature classification, an applied voltage required for obtaining a target temperature targeted at the time of driving after mounting into a vehicle for a central product of glow plugs belonging to the classification is acquired as an actual applied voltage for each of the classifications, a ratio of the actual applied voltage for each of the classifications to a standard applied voltage, which is a voltage applied to the glow plug at the time of driving that is set on the basis of a central product of all of the glow plugs to be used, is calculated as each correction coefficient, and the correction coefficient map is configured such that the corresponding correction coefficient calculated is readable from the group code.

* * * * *